US006524401B2

(12) United States Patent
Watanabe et al.

(10) Patent No.: US 6,524,401 B2
(45) Date of Patent: Feb. 25, 2003

(54) PROCESS FOR NITRIDING AN ALUMINUM-CONTAINING SUBSTRATE

(75) Inventors: Morimichi Watanabe, Nagoya (JP); Shinji Kawasaki, Nagoya (JP); Takahiro Ishikawa, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/918,097

(22) Filed: Jul. 30, 2001

(65) Prior Publication Data

US 2002/0076942 A1 Jun. 20, 2002

(30) Foreign Application Priority Data

Aug. 2, 2000 (JP) ..... 2000-234302

(51) Int. Cl.[7] ..... C23C 8/24
(52) U.S. Cl. ..... 148/238
(58) Field of Search ..... 148/238

(56) References Cited

U.S. PATENT DOCUMENTS 3,775,096 A * 11/1973 Guidotti et al. ..... 75/622
4,768,757 A 9/1988 Nakamura et al.
5,865,908 A 2/1999 Takei et al.

OTHER PUBLICATIONS

*Patent Abstracts of Japan*, vol. 1996, No. 7, Jul. 31, 1996 (JP 08 060336).
*Patent Abstracts of Japan*, vol. 012, No. 301, Aug. 16, 1988 (JP 63 075000).

* cited by examiner

*Primary Examiner*—Roy King
*Assistant Examiner*—Harry D Wilkins, III
(74) *Attorney, Agent, or Firm*—Burr & Brown

(57) ABSTRACT

While a nitride film is formed on a substrate containing metallic aluminum, a fluctuation in forming nitride film can be prevented, or the formation of the nitride film can be accelerated. A substrate containing at least metallic aluminum is subjected to a heating treatment in vacuum of $10^{-3}$ torr or less, and subsequently it is subjected to a heating/nitriding treatment in a atmosphere containing at least nitrogen to form a nitride film. A porous body through which a nitrogen atoms containing gas flow is clarified by heating at a temperature of 1000° C. or more under pressure of $10^{-4}$ torr or less, and then the porous body is contacted the atmosphere during the heating/nitriding step.

28 Claims, 2 Drawing Sheets

PROCESS FOR NITRIDING AN ALUMINUM-CONTAINING SUBSTRATE

BACKGROUND OF THE INVENTION (1) Field of the Invention

The present invention relates to a process for nitriding an aluminum-containing substrate.

(2) Description of the Related Art

As wirings in the semiconductors and liquid crystal panels become finer, fine workings with dry processings are progressing. With the demand for such fine workings, halogen-based corrosive gases are used as film-forming gases or etching gases for the semiconductors and the like. On the other hand, it is known that aluminum nitride exhibits high corrosion resistance against such halogen-based corrosion gases. Therefore, members having aluminum nitride on their surfaces have been used in semiconductor-producing apparatuses, liquid crystal panel producing apparatuses and the like. More specifically, there are available powdery aluminum nitride-sintered materials, materials in which an aluminum nitride film is formed on a substrate by using a vapor deposition such as CVD, and materials in which a surface of aluminum is modified and aluminum nitride is formed thereon.

When aluminum contacts air, its surface is oxidized to form a thin oxidized film. Since this oxidized film is an extremely stable passive phase, the surface of aluminum can not be nitrided by a simple nitriding method. Under the circumferences, the following methods have been specially developed to modify the surface of aluminum and form aluminum nitride thereon.

JP-A-60-211061 discloses a method in which after the inner pressure of the chamber is reduced to a given level and hydrogen or the like is introduced thereinto, discharging is performed to heat the surface of aluminum to a given temperature, further argon gas is introduced and discharging is performed to activate the surface of aluminum, and the surface of the aluminum is ionically nitrided through introducing nitrogen gas.

JP-A-7-166321 discloses a method in which a nitriding aid made of aluminum powder is contacted with the surface of aluminum, and aluminum nitride is formed on the surface of aluminum through heating in a nitrogen atoms-containing atmosphere.

However, according to the method described in JP-A-60-211061, since aluminum nitride is formed by using discharging, the entire device is complicated to raise the cost. Further, it is difficult for this method to nitride members having complicated shapes or large sizes.

Furthermore, according to a method described in JP-A-7-166321, since a nitriding aid is used, voids exist in a resulting surface layer of aluminum nitride so that denseness is not sufficient. For this reason, it is an actual situation that corrosion resistance of the surface against the halogen-based corrosive gas is not sufficient and not practicable.

Moreover, when sintered aluminum nitride is to be used, since aluminum nitride powder is necessary to be sintered at a high temperature and the sintered body is difficult to be worked, there is a problem of a high cost. Further, it is extremely difficult to form members having large sizes or complicated shapes. In the case that aluminum nitride is formed by CVD process, there are such problems that members having large sizes or complicated shapes are difficult to be formed, and the device and the process are complicated and expensive.

NGK Insulator, Ltd. discloses a technique in Japanese Patent Application No. 11-059011 (JP-A-2000-290767), in which surface of aluminum by heating the aluminum in the nitrogen atmosphere immediately after heating it in vacuum. However, depending on various conditions such as the shape of a container and the number of times of growing the films, the quality of the nitride film is degraded, or the growing rate of the film is decreased, or, in some cases, the nitride film is extremely difficult to be grown. For this reason, the technique may cause a disadvantageously large fluctuation as a nitride film producing method.

SUMMARY OF THE INVENTION

It is an object of the present invention to provide a process for producing a nitride film with a stable quality, when the nitride film is formed on an aluminum containing substrate.

It is another object of the present invention to reduce a fluctuation of a film forming state of the nitride film, when the nitride film is formed on an aluminum-containing substrate.

The first aspect of the present invention relates to a process for nitriding a substrate containing at least metallic aluminum, said process comprising the steps of heating the substrate in vacuum of $10^{-3}$ torr or less, and heating/nitriding the substrate in an atmosphere containing at least nitrogen continuously to said heating step, wherein a porous body through which a nitrogen atoms-containing gas can flow is clarified by heating at a temperature of 1000° C. or more under a pressure of than $10^{-4}$ tort or less and then contacted with the atmosphere during the heating/nitriding step.

The second aspect of the present invention relates to a process for nitriding a substrate containing at least metallic aluminum, said process comprising the steps of heating said substrate in vacuum of $10^{-3}$ ton or less, and heating/nitriding the substrate in an atmosphere containing at least nitrogen continuously to said heating step, wherein said heating/nitriding step is repeated two or more times and an amount of each of magnesium, lithium and calcium absorbed by said porous body is controlled to 0.5 ppm or less before subjecting it to the next heating/nitriding step.

The third aspect of the present invention relates to a process for nitriding a substrate containing at least metallic aluminum, said process comprising the steps of heating said substrate in vacuum of $10^{-3}$ torr or less, and heating/nitriding the substrate in an atmosphere containing at least nitrogen continuously to said heating step, wherein said heating/nitriding step is performed after a structural body of a furnace body for said heating/nitriding step is clarified by heating at a temperature of 1000° C. or more under a pressure of $10^{-4}$ torr or less.

The forth aspect of the present invention relates to a process for nitriding a substrate containing at least metallic aluminum, said process comprising the steps of heating a substrate containing at least metallic aluminum in vacuum of $10^{-3}$ torr or less, and heating/nitriding the substrate in an atmosphere containing at least nitrogen continuously to said heating step, wherein said heating/nitriding step is repeated two or more times and an amount of each of magnesium, lithium and calcium absorbed by said structural body of the furnace body is controlled to 0.5 ppm or less before subjecting it to the next heating/nitriding step.

BRIEF DESCRIPTION OF THE DRAWINGS

For a better understanding of the invention, reference is made to the accompanying drawings, wherein:

FIG. 1(*b*) is a diagram showing a state in which a substrate 6 and an object 7 are placed in a dense vessel body 8 and a porous lid 3;

Description Of The Preferred Embodiment

Figure 1A:
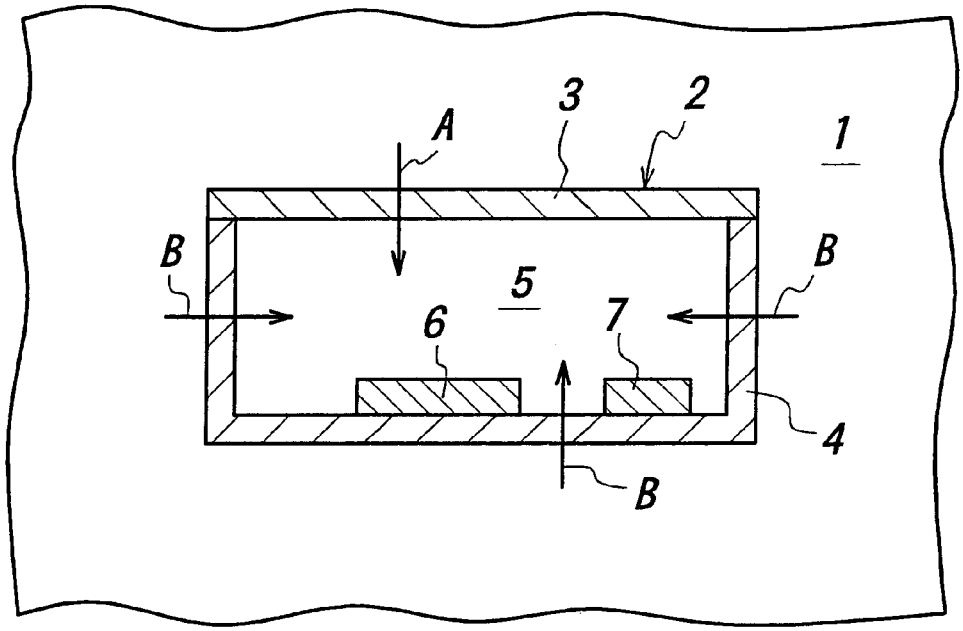
FIG. 1(*a*) is a diagram showing a state in which a substrate 6 and an object 7 are placed in a porous vessel body 4 and a porous lid 3.

The present inventors have repeated investigations strenuously to discover a new method for forming a nitride on a surface of a metallic aluminum containing substrate in a simple manner. As a result, the present inventors discovered that a nitride film may be formed on a aluminum substrate by, for example, heating the substrate made of a metallic aluminum at a high vacuum degree before forming the nitride film. Although a reason for this is not clear, it is considered that an aluminum passive film on the surface of the aluminum substrate is removed by heating at the high vacuum degree.

An atmosphere in the vessel contained at least nitrogen during a heating/ nitriding step. It was found that the nitride film was readily and stably formed on the substrate, or the growing rate of the nitride film was increased by contacting a porous body with the atmosphere during the heating/ nitriding step. In some cases, it was observed that the quality of the nitride film thus formed tended to be improved.

The present inventors conducted various experiments to ascertain the reason for the above, and finally reached the following inference.

That is, in a case of the above-mentioned nitriding reaction, the nitriding reaction seems to be accelerated due to the presence of a vapor of a metallic element, such as magnesium, in an atmosphere. The metallic vapor in the atmosphere is considered to have an effect of reducing the passive film on the surface of the metallic aluminum, or to react with nitrogen in the atmosphere to form an intermediate compound. Such metal-nitrogen inter mediate compound. Such metal-nitrogen intermediate compound is considered to have an effect of accelerating the nitriding reaction.

The present inventors tried to place a metal source, for example, an ingot of metallic magnesium or alloys, in the vessel to accelerate the supply of such metallic element, and confirmed that the formation of the nitride film was thereby accelerated.

On the other hand, the nitride film tends to be difficult to form on the substrate, or the quality of the nitride film tends to be deteriorated, when the partial pressures of oxygen or water vapor in the vessel exceeded a given value, while the substrate is held at high temperature in vacuum. The present inventors observed a metal mass coexisted in the vessel, when such interruption of the formation of the nitride film occurred. As a result, it was found that an oxide film was formed on the surface of the metal mass placed. Because the oxide film was thus formed on the surface of the metal mass, it was considered that the metallic vapor could not diffuse into the atmosphere and caused the incomplete formation of the nitride film. Such production of the metal oxide film was caused by increases in concentration of oxygen and water vapor existing in the atmosphere.

When the substrate was heated in the nitrogen atmosphere immediately and directly from the air without a pre-processing of holding the substrate in vacuum at a high temperature, the nitride film was not formed as well. Such a phenomenon was similar to the above-mentioned incomplete formation of the nitride film due to the formation of the metal oxide film.

The present inventors also found that the above-mentioned metal oxide or hydroxide was formed in the atmosphere after the heating/nitriding step, when such incomplete formation of the nitride film was caused. MgO and $Mg(OH)_2$ may be recited by way of example as such nitride-inhibitor. It is known that $Mg(OH)_2$ decomposes at about 350° C. to produce $H_2O$, and MgO reacts with the moisture in the air at room temperature to transform to $Mg(OH)_2$. Therefore, it is considered that the above-mentioned process of the incomplete formation of the nitride film is caused by the moisture supplied from such a metal oxide and a hydrogen oxide to the atmosphere.

Based on this hypothesis, the present inventors conceived to arrange a porous body to contact the atmosphere in the vessel during the heating/nitriding step, and clarify the porous body to remove the aforementioned nitride-inhibitors such as metal oxides and metal hydroxides. As a result, the present inventors found that this process is effective for reducing the passive film and for forming the nitride film.

It is considered that the surface of the porous body readily absorbs active metallic vapors, thereby having an effect of condensing metals on the surface of the vessel.

As mentioned above, an intermediate compound of a metal other than aluminum possibly intervenes in a reaction of forming the nitride film. Thus, it is considered that a gas phase-solid phase reaction is caused between the metal and nitrogen absorbed on the surface of the porous body by arranging the porous body to contact the atmosphere in the vessel during the heating/nitriding step. Since the gas phase-solid phase reaction has a larger cross-section area than that of a gas phase-gas phase reaction, the aforementioned formation of the intermediate compound is considered to be accelerated.

Absorption of metals or compounds thereof by the porous body and its influence on the formation of the nitride film will be further described.

A porous vessel having absorbed the aforementioned specific metals, its vapor or its nitrides may sometimes react with oxygen or moisture to become a carrier of oxygen or moisture. When the vessel is reused, these oxides, hydroxides and the like release oxygen or moisture in a heating/ nitriding furnace to strengthen the oxide film on the surface of the substrate or an oxide coating on a surface of a vapor-supplying material such as Mg to reduce an amount of released metallic vapor, thereby interrupting destruction of the oxide film.

For example, Mg reacts with nitrogen to form $Mg_3N_2$ upon nitriding, and then reacts with oxygen and water to form $Mg(OH)_2$ and MgO upon contact with outside air. Since $Mg(OH)_2$ is decomposed into $MgO+H_2O$ at 350° C. and releases water, the above problem is caused. In a case of MgO being absorbed by the porous vessel body, since oxygen may be released, a part of MgO is transformed to $Mg(OH)_2$,and then releases $H_2O$ to cause the above problem as well.

Moreover, Li and Ca, which are useful elements for destructing the oxide film like Mg, show similar behaviors.

In order to completely remove these elements from the porous body, especially from the vessel, it was effective to conduct the clarifying step at a high temperature under a reduced pressure, taking a vapor pressure of the compound into consideration. Hydroxide may be transformed to oxide at a relatively low temperature. However, although the hydroxide itself is disappeared, an inhibition of the formation of the nitride film cannot be restrained unless the transformed oxide and even a pure metal are completely removed since they may return to the hydroxide again upon contacting the outside air. Due to an extremely low vapor pressure of the oxide as compared with that of the pure metal or hydroxide, it is difficult to remove it.

For example, the vapor pressures of MgO, LiO and CaO are $5.0\times10^{-17}$, $4.7\times10^{-12}$ and $7.3\times10^{-19}$ torrs at 1000K, respectively; $1.5\times10^{-8}$, $2.4\times10^{-4}$ and $4.5\times10^{-9}$ torrs at 1500K, respectively; and $1.3\times10^{-3}$, $6.4\times10^{-1}$ and $3.0\times10^{-4}$ torrs at 2000K, respectively (each data is cited from *Kagaku Binran* (Chemical handbook)). Therefore, when the pressure is reduced below these vapor pressures in these temperature ranges, oxide must be able to be effectively removed.

In this way, according to the present invention, by once clarifying the porous body, particularly the porous vessel before reusing, the formation of the nitride film on the substrate can be further accelerated.

The present inventors also found that a similar mechanism of inhibition of the nitride film exists in a so-called structural body of a furnace body, and thus a clarifying treatment similar to the treatment for the porous body is also useful for the structural body of the furnace body.

The structural body of the furnace body herein indicates a structural body constituting a furnace body in a certain way and contacting the atmosphere during heating/nitriding treatment. More particularly, a heating element (especially, a carbon heating element) and an insulator (especially, a porous insulator such as glass wool) may be recited by way of examples.

The pressure during the clarifying treatment of the porous body and the structural body of the furnace body should be $10^{-4}$ torr or less. More preferably, it is $10^{-6}$ or less.

Although a temperature during the clarifying treatment of the porous body and the structural body of the furnace body may be set according to a kind of the involving metal, it should be typically 1000° C. or more, and more preferably 1200° C. or more.

An amount of each of magnesium, lithium and calcium absorbed by the porous body after the aforementioned clarifying treatment is preferably controlled to 0.5 ppm or less, which is the lowest region of present analytical instruments of inductively coupled plasma analysis (ICP analysis).

More preferably, an amount of each of metals belonging to Group 1A, Group 2A, Group 3A, Group 4A and Group 4B in Periodic Table absorbed by the porous body after the clarifying treatment is 0.5 ppm or less.

Further, the present invention relates to a process for nitriding a substrate containing at least metallic aluminum, said process comprising the steps of heating said substrate in vacuum of $10^{-3}$ torr or less, and heating/nitriding the substrate in an atmosphere containing at least nitrogen continuously to said heating step, wherein said heating/nitriding step is repeated two or more times and an amount of each of magnesium, lithium and calcium absorbed by the porous body is controlled to 0.5 ppm or less before subjecting it to the next heating/nitriding step.

Such a controlling method is also useful for the structural body of the furnace body.

By adapting such a controlling method, the nitride film can be stably and continuously mass-produced.

The process for producing the nitride film adapted by the present invention will be further described in detail below.

In a preferred embodiment, the substrate is shielded from an external environment by the porous body.

As mentioned in the above, a larger concentration of the metallic vapor than the given level is necessary to cause the nitriding reaction. The metallic vapor can be held on inner surfaces of pores of the porous body by shielding the substrate from the external environment with the porous body. Moreover, nitrogen can be introduced into the substrate through the porous body by substituting an external atmosphere with nitrogen. At this point, the metallic vapor held in the porous body reacts with nitrogen flowing through the porous body by the gas phase-solid phase reaction to form an intermediate compound as described in the above, which accelerates the nitriding reaction at the surface of the substrate.

In a preferred embodiment, the substrate is placed in a vessel having at least a lid made of the porous body. In this case, at least the lid of the vessel is exposed to a nitrogen atmosphere to introduce a nitrogen atoms-containing gas into the vessel through the lid.

In a preferred embodiment, the substrate is placed in a vessel made of the porous body. Therefore, an efficiency of the formation of the nitriding film can be improved.

In another preferred embodiment, when at least the nitrogen atoms-containing gas is supplied toward the substrate, the porous body is placed in a gas-supplying path for the nitrogen atoms-containing gas. By so placing, the above-mentioned gas phase-solid phase reaction can be accelerated inside the porous body in the gas-supplying path for the nitrogen atoms-containing gas.

In a preferred embodiment, the atmosphere with which the substrate is contacted contains a vapor of at least one metal selected from the group consisting of Group 2A, Group 3A, Group 4A and Group 4B in Periodic Table. These metallic vapors particularly accelerate the formation of the nitride film.

A method for incorporating the metallic vapor in the atmosphere is not particularly limited. In an embodiment, a metal or an alloy containing at least one metallic element selected from the group consisting of Group 1A, Group 2A, Group 3A, Group 4A and Group 4B in Periodic Table is placed in the vessel. In another embodiment, a metal or an alloy containing at least one metallic element selected from the group consisting of Group 2A, Group 3A, Group 4A and Group 4B in Periodic Table is placed in the gas-supplying path for the nitrogen atoms-containing gas.

Among such metals, Li, Mg, Sr, Ca, Ba, Be, Ce, Ti, Zr, B and Si are particularly preferred. More preferably, the metal contains magnesium.

These metals may be placed as an elemental substance to contact said atmosphere. Alternatively, as the above-mentioned alloy, an alloy containing two or more of these metals, or an alloy of the above metal(s) and aluminum is preferred. A6061 (Mg—Si based alloy), A7075 (Zn—Mg based alloy) and A5083 (Mg based alloy) may be recited by way of example as aluminum alloys.

The porosity of the porous body is preferably not less than 1%, more preferably not less than 3% to exert the above function and effect. The porosity of the porous body is preferably not more than 30% to maintain the vapor of the above-mentioned metal or the intermediate compound in the vessel at more than a certain amount.

A pore size of the porous body is preferably not less than 1 $\mu$m, more preferably not less than 3 $\mu$m to capture the metallic vapor and to flow the nitrogen atoms-containing gas through it. The pore size of the porous body is preferably not more than 100 $\mu$m to maintain the vapor of the above-mentioned metal or the intermediate compound in the vessel at more than a certain amount, and to secure a reaction surface area on which said intermediate compound is formed.

The material of the porous body is not particularly limited, but it is necessary to have no possibility to diffuse oxygen or other nitriding inhibitors during the nitriding treatment.

Graphite free from impurities is preferably used as a material forming the porous body. As well, for example, nitrides such as silicon nitride or aluminum nitride, and carbide such as silicon carbide are preferably used as a porous ceramic material.

It is considered that graphite is highly reactive with oxygen, thereby having an effect of reducing a partial pressure of oxygen in the atmosphere. Since oxygen and water molecules are considered to have an effect of inhibiting the nitriding reaction from said mechanism, their partial pressure is preferably reduced as much as possible. When a vessel made of graphite is actually used, the producing rate of the film exhibited an advantage over the case of using a vessel made of porous silicon carbide.

According to the present invention, after the substrate is heated in vacuum, the nitrogen atoms-containing gas is supplied to the vessel to conduct the heating/nitriding treatment while maintaining the vacuum state.

According to the present invention, the substrate needs to be heated under vacuum of not more than $10^{-3}$ torr, and preferably not more than $5\times10^{-4}$ torr.

The lower limit of the pressure in vacuum is not particularly limited, but it is preferably $10^{-6}$ torr, and more preferably $10^{-5}$ torr. A larger pump and a higher vacuum tolerant chamber are necessary to achieve a higher vacuum degree, thereby raising the cost. Further, such a lower limit does not affect the nitride-forming rate.

The lower limit for the temperature of the heating treatment is not particularly limited as far as even a portion of an oxide film on the surface of the substrate may be removed. However, to efficiently generate and keep the vapor of the above-mentioned metal or the intermediate compounds and to efficiently destroy the oxide film, the lower temperature limit is preferably 450° C., and more preferably 500° C.

The upper limit of the temperature in the heating treatment is preferably 650° C., and more preferably 600° C., when the melting point of an aluminum alloy used for the substrate is taken into account. By so setting, thermal deformation of the substrate can be prevented.

$N_2$ gas, $NH_3$ gas and $N_2/NH_3$ mixed gas may be recited by way of example as the nitrogen atoms-containing gas. Particularly, it is preferable to contain $N_2$ gas.

In order to form a thick nitride film on the heating-treated substrate in a relatively short time, the gas pressure of the nitrogen atoms-containing gas is preferably set at 1 kg/cm$^2$ or more, more preferably in a range from 1 to 2000 kg/cm$^2$, and particularly preferably in a range from 1.5 to 9.5 kg/cm$^2$.

The heating temperature in the heating/nitriding treatment is not particularly limited as far as the nitride film may be formed on the surface of the substrate. However, to form a relatively thick nitride film in a relatively short time, the lower limit of the heating temperature is preferably 450° C., and more preferably 500° C.

Further, the upper limit of the heating temperature in the heating/nitriding treatment is preferably 650° C. , and more preferably 600° C. By so setting, thermal deformation of the substrate can be effectively prevented.

The nitride thus formed on the surface of the substrate is not necessarily present in the form of a layer or a film. That is, the form is not limited as far as the nitride is formed in such a state that it can afford corrosion resistance on the substrate itself. Therefore, the form includes a state in which fine particles are densely dispersed or a state in which the composition of the nitride inclines toward the substrate with an interface between the nitride and the substrate being unclear.

When the nitride film is formed after the substrate or the surface of the substrate being coated, the surface is required to contain at least metallic aluminum. It is because aluminum nitride is formed on the surface by nitriding the metallic aluminum.

Preferably, the substrate is at least one selected from the group consisting of a metal containing at least metallic aluminum, an intermetallic compound containing aluminum atoms, a composite material of the metal containing at least aluminum and the intermetallic compound containing aluminum atoms, a composite material of the metal containing at least aluminum and a low heat expansion material, and a composite material of the metal containing at least aluminum, the intermetallic compound containing aluminum atoms and the low heat expansion material.

As the low expansion material, AlN, SiC, $Si_3N_4$, $Al_2O_3$, Mo, W and carbon may be recited by way of example. These materials are effective in controlling the physical and mechanical properties of the composite material. The content of the low thermal expansion material is preferably in a range from 10 to 70 vol %.

As the metal containing at least aluminum, pure metallic aluminum or alloys of aluminum and other metal(s) may be used. As the metals alloyed with aluminum, metals comprising at least one selected from elements such as Li in Group 1A in Periodic Table, elements such as Mg, Sr, Ca, Ba and Be in Group 2A in Periodic Table, elements such as Ce in Group 3A in Periodic Table, elements such as Ti and Zr in Group 4A in Periodic Table, and elements such as B and Si in Group 4B in Periodic Table are preferred from the standpoint of being effective for removing the oxide film and accelerating the formation of the nitride film,.

A6061 (Mg—Si based alloy), A7075 (Zn—Mg based alloy) and A5083 (Mg based alloy) may be recited as a specific examples for the aluminum alloy constituting the substrate.

As the intermetallic compound containing aluminum atoms, $Al_3Ni$, $Al_3Ni_2$, AlNi, $AlNi_3$, $AlTi_3$, AlTi, $Al_3Ti$, etc. may be recited by way of example.

As the substrate, composite materials in which a member made of a metal, a ceramic material and a composite material thereof are surface-coated with aluminum or an aluminum alloy may be used.

The nitride formed on the surface of the substrate preferably contains at least one element selected from the group consisting of metals of Group 2A, Group 3A, Group 4A and Group 4B in Periodic Table at a higher concentration than in the surface of a metallic portion of metallic aluminum in the substrate.

The content of at least one element selected from the group consisting of metals of Group 2A, Group 3A, Group 4A and Group 4B in Periodic Table is preferably not less than 1.1 times, and more preferably not less than 1.5 times as much as that in the metallic aluminum in the substrate.

Further, at least one element selected from the group consisting of metals of Group 2A, Group 3A, Group 4A and Group 4B in Periodic Table and the oxygen content are dispersed in the nitride uniformly in the thickness direction thereof from the standpoint of stabilizing the stress concentration, heat fatigue and mechanical properties.

The nitride having the above-mentioned oxygen content distribution and containing at least one element selected from the group consisting of metals of Group 2A, Group 3A, Group 4A and Group 4B in Periodic Table has excellent corrosion resistance as a protective film, since fluoride formed by these elements on exposing to fluorine atmosphere has a small vapor pressure. For this reason, when the nitride is exposed to the above-mentioned corrosive gas, change in weight of the nitride is extremely small, and particularly extremely smaller as compared with a case where the substrate is exposed to the corrosive gas.

In order that the nitride containing at least one element selected from the group consisting of metals of Group 2A, Group 3A, Group 4A and Group 4B in Periodic Table may have high hardness, high toughness and high corrosion resistance, the thickness of the nitride is preferably not less than 2 $\mu$m, more preferably not less than 5 $\mu$m.

To conduct the present invention, for example, a substrate is placed on a sample table inside a chamber equipped with a vacuum device. Next, this chamber is evacuated with the vacuum pump until a given vacuum degree is achieved. Then, the substrate is heated with a heater, such as a resistant heating element or an infrared lamp arranged in the chamber, until a given temperature is achieved. The substrate is kept at this temperature for 1 to 10 hours. In the heating treatment, the entire substrate does not need to reach that temperature, but at least a surface portion of the substrate on which a passive film is formed reached the given temperature.

After the heating treatment has finished, the interior of the chamber is replaced with a nitrogen gas atmosphere by introducing the nitrogen gas or the like into the chamber. By adjusting the input power of the heater, the substrate is heated to a given temperature. Then, the substrate is hold at this temperature for 1 to 30 hours. Also in this case, the entire substrate does not need to reach the given temperature, but at least a surface portion of the substrate on which the nitride film is to be formed reaches the given temperature.

After the given time has passed, the heating/nitriding treatment is terminated by controlled cooling or by cooling the furnace. Then, the substrate is taken out from the chamber.

The nitriding-treated substrate according to the present invention can be used as a component in the semiconductor-producing apparatuses, the liquid crystal producing apparatuses, the automobiles, etc.

Further, the nitriding-treated substrate according to the present invention has excellent heat emission property. Therefore, the nitriding-treated substrate according to the present invention can be favorably used in a heat emission component requiring the heat emitting property.

Figure 1B:
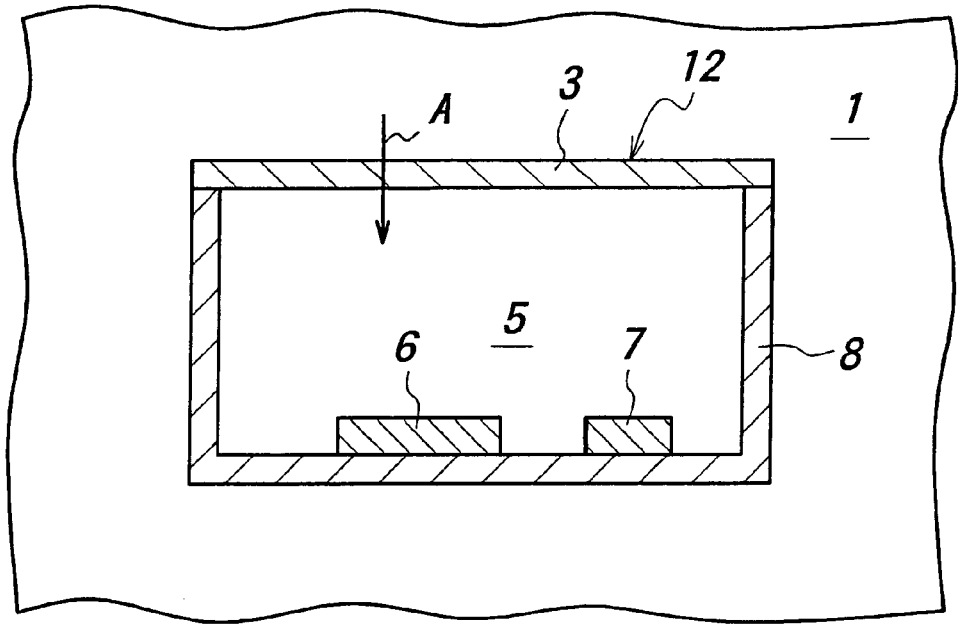

Referring to FIG. 1(*a*), a vessel 2 made of a porous body is placed in an atmosphere 1 containing at least a nitrogen atoms-containing gas. The vessel 2 consists of a lid 3 and a vessel body 4. During the heating/nitriding treatment, at least the nitrogen atoms-containing gas is supplied from the atmosphere 1 to the interior atmosphere 5 in the directions as indicated by the arrows A and B. In the vessel body 4, the substrate 6, an object 7 made of a metal containing at least one element selected from the group consisting of metals of Group 2A, Group 3A, Group 4A and Group 4B in Periodic Table, or an alloy thereof are placed. In this state, the substrate is subjected to the heating/nitriding treatment.

Referring to FIG. 1(*b*), a vessel body 8 of a vessel 12 is made of a dense body, and a lid 3 is made of a porous body.

Figure 2:
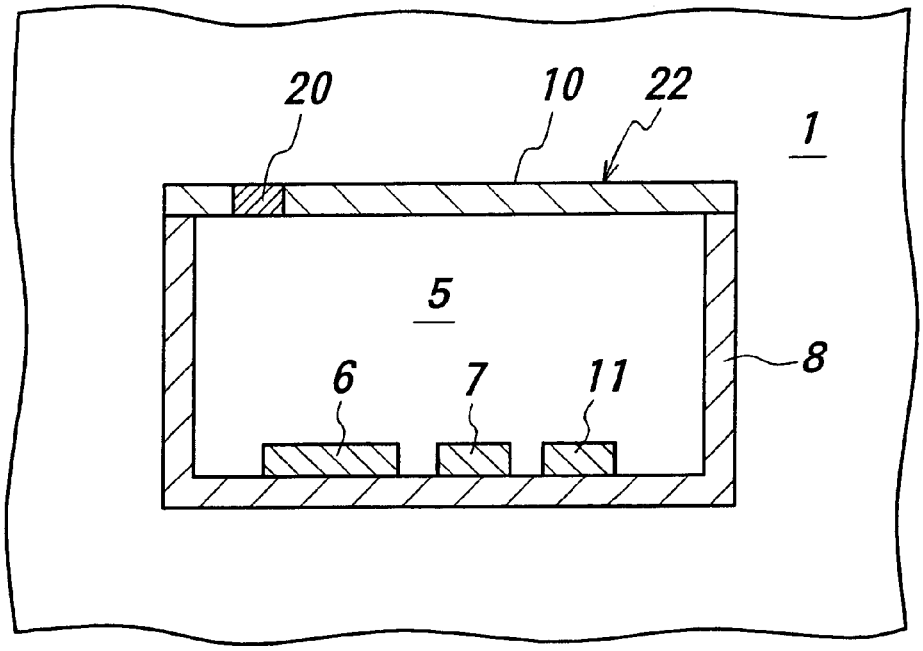
FIG. 2 is a diagram showing a state in which a substrate 6, a set object 7 and a porous body 11 are placed in a dense vessel body 8 and a dense lid 10.

Referring to FIG. 2, both of a vessel body 8 and a lid 10 of a vessel 22 are made of a dense body. A valve 20 is provided on, for example, the lid 10. A substrate 6, the above-mentioned object 7 and a porous body 11 are placed in the vessel body 8. In this state, the substrate is heated in vacuum, and then the nitrogen atoms-containing gas is introduced through the valve 20 to conduct the heating/nitriding treatment.

Figure 3:
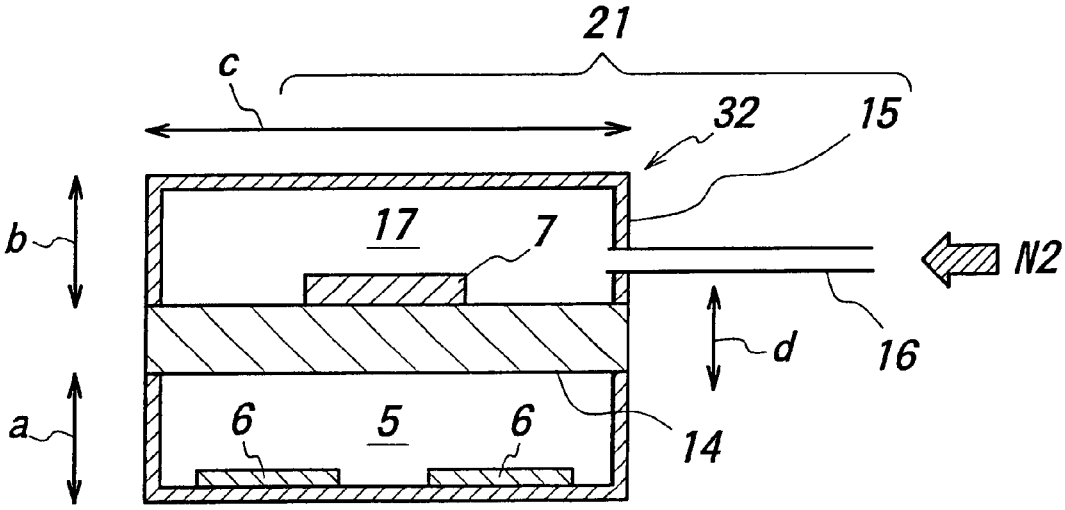
FIG. 3 is a diagram showing a state in which a vessel 32 is divided by a shield plate 14 and an object 7 is placed in a nitrogen-supplying path 21.

Referring to FIG. 3, a shield plate 14 made of a porous body is placed in a vessel 32 comprising a dense body 15 to divide the inner space of the vessel 32 into, for example, two spaces 5 and 17. A substrate 6 is a placed in an atmosphere 5. The above-mentioned object 7 is placed in an atmosphere 17. A supplying tube 16 is connected to be able to communicate with the atmosphere 17 to supply, for example, a nitrogen gas is supplied into the atmosphere 17 through the supplying tube 16. The substrate 6 is shielded from the external atmosphere by the shield plate 14, and the set object 7 is placed in the supplying path 21 for the nitrogen gas.

EXAMPLES

In the following, the present invention will be explained based on specific examples.

(Examples 1–10)

For each of Examples, a nitride film was produced according to conditions of heating treatment and heating/nitriding treatment as respectively shown in Table 1. Then, a structural body of a furnace body (including a heat-insulating glass wool material) and porous vessel used for each of Examples were clarified according to pre-treatment conditions as respectively shown in Table2. Thereafter, nitride film was produced again according to the conditions as shown in Table 1. Physical properties of the nitride films produced by the second nitride film-forming treatment are shown in Tables 3 and 4.

More specifically, pure aluminum (A1050: Al content>99.5%) and a Mg-Si based A1 alloy (A 6061: Mg-0.6Si-0.2Cr-0.3Cu), both of which had dimensions of 20×20×2 mm, were used as substrates.

As shown in Table 1, combination of a cup-shaped vessel body 4 made of graphite (porosity 10%) and a lid 3 made of graphite (porosity 10%, screw type) as shown in FIG. 1(*a*) was used as a reaction vessel in Examples 1–8. In Examples 9 and 10, a combination of a lid 3 made of a recrystallized silicon carbide porous body (porosity 20%, pore size 60 $\mu$m) and the vessel body 4 as shown in FIG. 1(*a*) was used as the reaction vessel. All of the vessels had dimensions of 90 mm in inner diameter and 7 mm in height, and were formed in cup-shape.

In the first nitride film-forming treatment, three A1050 plates and three A6061 plates were placed as the substrates. The aforementioned reaction vessel was placed in an electric furnace equipped with a graphite heater, and the furnace was evecuated to a vacuum degree given in Table 1 with a vacuum pump. Then, the substrate was heated to a temperature given in Table 1 by passing current through the graphite heater, and the vacuum degree was held at this temperature for a period of time given in Table 1 (heating treatment under vacuum).

Thereafter, nitrogen gas was introduced into the electric furnace to reach a set pressure given in Table 1. After the set pressure was achieved, the nitrogen gas was introduced at a rate of 2 liter/min., and an inside pressure of the furnace was controlled to the set pressure with ±0.05 kg/cm$^2$. Then, the temperature and the holding time of the substrate was set as shown in Table 1, and a nitride film was formed on the surface of the substrate (heating/nitriding treatment).

When the nitride film-formed substrate was cooled to 50° C. or less, the substrate was taken out from the chamber.

Then, the porous vessel was placed in the electric furnace, and clarified with glass wool of the structural body of the furnace body under the conditions of temperature, vacuum degree and heating time as shown in Table 2.

Each of the porous vessels and about 3 g of glass wool were immersed into 3.6% hydrochloric acid (50 cc) at 160° C. after the clarifying treatment. After the solution was heated for 30 minutes, elements dissolved into the solution were measured by the ICP analysis. Taking the sample weight into consideration, a detection limit of the ICP analysis was 0.5 ppm.

The heating treatment and the heating/nitriding treatment were conducted under the same vacuum condition as mentioned in the above using each of the porous vessel after the clarifying treatment. Conditions of these treatments were shown in Table 1.

TABLE 1

| | Heating condition | | | Heating/nitriding condition | | | Reaction Vessel | | | |
|---|---|---|---|---|---|---|---|---|---|---|
| Example | Vacuum degree (torr) | Temp. (° C.) | Time (hr) | $N_2$ Gas Pressure (kgf/cm$^2$) | Temp. (° C.) | Time (hr) | Material | Dimension | Material | Dimension |
| 1 | $1.2 \times 10^{-4}$ | 540 | 2 | 9.5 | 540 | 2 | graphite (porosity 10%) | ID: 90 mm H: 7 mm | graphite (porosity 10%) | ID: 100 mm H: 7 mm |
| 2 | $1.3 \times 10^{-4}$ | 540 | 2 | 9.5 | 540 | 2 | graphite (porosity 10%) | ID: 90 mm H: 7 mm | graphite (porosity 10%) | ID: 100 mm H: 7 mm |
| 3 | $1.1 \times 10^{-4}$ | 540 | 2 | 9.5 | 540 | 2 | graphite (porosity 10%) | ID: 90 mm H: 7 mm | graphite (porosity 10%) | ID: 100 mm H: 7 mm |
| 4 | $1.3 \times 10^{-4}$ | 540 | 2 | 9.5 | 540 | 2 | graphite (porosity 10%) | ID: 90 mm H: 7 mm | graphite (porosity 10%) | ID: 100 mm H: 7 mm |
| 5 | $1.2 \times 10^{-4}$ | 540 | 2 | 1 | 540 | 8 | graphite (porosity 10%) | ID: 90 mm H: 7 mm | graphite (porosity 10%) | ID: 100 mm H: 7 mm |
| 6 | $1.2 \times 10^{-4}$ | 540 | 2 | 1 | 540 | 8 | graphite (porosity 10%) | ID: 90 mm H: 7 mm | graphite (porosity 10%) | ID: 100 mm H: 7 mm |
| 7 | $1.3 \times 10^{-4}$ | 540 | 2 | 1 | 540 | 8 | graphite (porosity 10%) | ID: 90 mm H: 7 mm | graphite (porosity 10%) | ID: 100 mm H: 7 mm |
| 8 | $1.2 \times 10^{-4}$ | 540 | 2 | 1 | 540 | 8 | graphite (porosity 10%) | ID: 90 mm H: 7 mm | graphite (porosity 10%) | ID: 100 mm H: 7 mm |
| 9 | $1.1 \times 10^{-4}$ | 540 | 2 | 9.5 | 540 | 2 | Recrystallized silicon carbide (porosity 20%) | ID: 90 mm H: 7 mm | Recrystallized silicon carbide (porosity 20%) | ID: 100 mm H: 7 mm |
| 10 | $1.0 \times 10^{-4}$ | 540 | 2 | 1 | 540 | 8 | Recrystallized silicon carbide (porosity 20%) | ID: 90 mm H: 7 mm | Recrystallized silicon carbide (porosity 20%) | ID: 100 mm H: 7 mm |

TABLE 2

| | Conditions of pre-treatment of reaction vessel | | | Measured result of reaction vessel after heating (ICP analysis) | | | | Measured result of glass wool after heating (ICP analysis) | | | |
|---|---|---|---|---|---|---|---|---|---|---|---|
| Example | Temperature (° C.) | Vacuum degree (torr) | Heating time (hr.) | Al | Mg | Li | Ca | Al | Mg | Li | Ca |
| 1 | 2000 | $1.2 \times 10^{-4}$ | 2 | <0.5 | <0.5 | <0.5 | <0.5 | <0.5 | <0.5 | <0.5 | <0.5 |
| 2 | 1200 | $1.3 \times 10^{-4}$ | 2 | <0.5 | <0.5 | <0.5 | <0.5 | <0.5 | <0.5 | <0.5 | <0.5 |
| 3 | 2000 | $2.1 \times 10^{-6}$ | 2 | <0.5 | <0.5 | <0.5 | <0.5 | <0.5 | <0.5 | <0.5 | <0.5 |
| 4 | 1000 | $2.2 \times 10^{-6}$ | 2 | <0.5 | <0.5 | <0.5 | <0.5 | <0.5 | <0.5 | <0.5 | <0.5 |
| 5 | 1500 | $1.2 \times 10^{-4}$ | 2 | <0.5 | <0.5 | <0.5 | <0.5 | <0.5 | <0.5 | <0.5 | <0.5 |
| 6 | 1200 | $1.3 \times 10^{-4}$ | 2 | <0.5 | <0.5 | <0.5 | <0.5 | <0.5 | <0.5 | <0.5 | <0.5 |
| 7 | 1500 | $2.1 \times 10^{-6}$ | 2 | <0.5 | <0.5 | <0.5 | <0.5 | <0.5 | <0.5 | <0.5 | <0.5 |
| 8 | 1000 | $2.2 \times 10^{-6}$ | 2 | <0.5 | <0.5 | <0.5 | <0.5 | <0.5 | <0.5 | <0.5 | <0.5 |
| 9 | 2000 | $1.4 \times 10^{-4}$ | 2 | <0.5 | <0.5 | <0.5 | <0.5 | <0.5 | <0.5 | <0.5 | <0.5 |
| 10 | 1500 | $2.4 \times 10^{-6}$ | 2 | <0.5 | <0.5 | <0.5 | <0.5 | <0.5 | <0.5 | <0.5 | <0.5 |

Surface color tone of each of the nitrided substrates thus obtained is shown in Tables 3 and 4. When the surfaces of the nitrided substrate were subjected to the X-ray diffraction examination, peaks of aluminum nitride were observed in each of the substrates.

The surface of the substrate was also subjected to an EDS analysis, which also detect N, Mg and Si as well as Al. The measured quantities of the EDS analysis are shown in Tables 3 and 4. As an EDS analysis equipment, a combination of an SEM (Model XL-30) manufactured by Philips Co., Ltd. and an EDS detector (Model CDU-SUTW) manufactured by EDAX Co., Ltd was used. The plane analysis was conducted under conditions of an acceleration voltage of 20 kV and a magnification of X 1000.

Etching rates of a bubbling test were also measured on each of the surfaces of the substrates thus obtained to evaluate soundness of each of the nitride film. Specifically, 40 cc of 36% HCl was measured in a 50 cc beaker, and each of the nitride substrate was immersed into HCl in the beaker for 5 minutes. The soundness of the nitride film was evaluated with a weight change and a bubbling state of the substrates. Since the substrate was not etched by HCl, the bubbles were not generated where the aluminum nitride film was present. However, where the nitride film was thin, or where the substrate was insufficiently nitrided, HCl penetrated into and dissolved Al substrate to cause an etching phenomenon. The soundness was evaluated by comparing etching rates (amounts of weigh losses per unit areas).

carbide, a nitride film having higher quality was made. The clarifying treatment was effective in producing the higher-quality nitride film.

(Comparative Examples 1–6)

In each of Comparative Examples shown in Tables 5 and 6, in the same manner as in Examples, the nitride film was formed on the substrate, the vessel was clarified, the nitride film was formed again, and then characteristics of the nitride film thus finally obtained were measured. More specifically, as shown in Table 7, substrates made of the A6061 alloy or the A1050 alloy were used for each of Comparative Examples. Heating and heating/nitriding conditions for the first and the second nitride film formations are shown in Table 5. As the reaction vessel, graphite having the porosity of 10% was used in Comparative Example 1–4, and recrystallized silicon carbide having the porosity of 20% was used in Comparative Examples 5–6.

After the first nitride film formation had been finished, each of the used vessel and glass wool was pre-treated according to conditions shown in Table 6. In each of Comparative Examples, since a temperature of the pre-treatment of the vessel was less than 1000° C. or a vacuum degree was on the order of $10^{-2}$ torn, the clarifying of the vessel was insufficient and Al, Mg, Li and Ca were detected in some measure.

As a result, in Comparative Examples 1–6, the nitride film was not formed and the etching rate of the substrate was

TABLE 3

| Example | Substrate | Crystal phase | Film thickness (μm) | Result of EDS analysis N | Mg | Al | Si | Color | Etching rate (mg/cm²) |
|---|---|---|---|---|---|---|---|---|---|
| 1 | Mg—Si based Al alloy A6061 | AlN, Al | 20 | 20.6 | 4.25 | 68.4 | 6.75 | grayish brown | 0.01 |
| | Pure Al (>99.5%) A1050 | AlN,Al | 96 | 23.4 | 1.1 | 73.4 | 2.05 | black | 0.02 |
| 2 | Mg—Si based Al alloy A6061 | AlN,Al | 13 | 14.5 | 3.78 | 76.1 | 5.61 | gray | 0.06 |
| | Pure Al (>99.5%) A1050 | AlN,Al | 41 | 16.7 | 1.04 | 80.7 | 1.56 | gray | 0.05 |
| 3 | Mg—Si based Al alloy A6061 | AlN,Al | 8 | 12.2 | 4.66 | 76.2 | 6.92 | gray | 0.21 |
| | Pure Al (>99.5%) A1050 | AlN,Al | 24 | 12.5 | 0.86 | 85.2 | 1.48 | gray | 0.17 |
| 4 | Mg—Si based Al alloy A6061 | AlN,Al | 15 | 17.2 | 5.78 | 71.1 | 5.9 | grayish brown | 0.04 |
| | Pure Al (>99.5%) A1050 | AlN,Al | 57 | 23.5 | 1.62 | 72.9 | 2.06 | black | 0.03 |
| 5 | Mg—Si based Al alloy A6061 | AlN,Al | 6 | 30.6 | 1.21 | 67 | 1.21 | grayish brown | 0.05 |
| | Pure Al (>99.5%) A1050 | AlN,Al | 60 | 26.6 | 1.11 | 71.9 | 0.3 | black | 0.00 |

TABLE 4

| Example | Substrate | Crystal phase | Film thickness (μm) | Result of EDS analysis N | Mg | Al | Si | Color | Etching rate (mg/cm²) |
|---|---|---|---|---|---|---|---|---|---|
| 6 | Mg—Si based Al alloy A6061 | AlN, Al | 3 | 24.2 | 2.45 | 71.7 | 1.63 | gray | 0.34 |
| | Pure Al (>99.5%) A1050 | AlN,Al | 20 | 18.6 | 1.22 | 79.9 | 0.3 | gray | 0.18 |
| 7 | Mg—Si based Al alloy A6061 | AlN,Al | 2 | 15.2 | 2.94 | 80.1 | 1.72 | gray | 0.52 |
| | Pure Al (>99.5%) A1050 | AlN,Al | 14 | 13.3 | 0.71 | 86 | 0 | gray | 0.23 |
| 8 | Mg—Si based Al alloy A6061 | AlN,Al | 5 | 25.6 | 2.84 | 70.1 | 1.52 | grayish brown | 0.02 |
| | Pure Al (>99.5%) A1050 | AlN,Al | 16 | 22 | 1.09 | 76.6 | 0.33 | black | 0.05 |
| 9 | Pure Al (>99.5%) A1050 | AlN,Al | 162 | 35.5 | 2.74 | 61.6 | 0.23 | black | <0.01 |
| 10 | Pure Al (>99.5%) A1050 | AlN,Al | 54 | 40.2 | 2.89 | 56.6 | 0.33 | black | <0.01 |

As clearly shown in Tables 3 and 4, a high-quality nitride film was produced in each of these Examples. Especially, in a case of using a vessel made of porous recrystallized silicon large. The reason of this is considered that Mg, Li or Ca was absorbed and remained on the vessel in some extent to prevent the formation of the nitride film.

TABLE 5

| Comparative Example | Heating condition: Vacuum degree (torr) | Heating condition: Temp. (° C.) | Heating condition: Time (hr) | Heating/nitriding condition: $N_2$ Gas Pressure (kgf/cm$^2$) | Heating/nitriding condition: Temp. (° C.) | Heating/nitriding condition: Time (hr) | Reaction Vessel: Material of vessel body | Reaction Vessel: Dimension | Reaction Vessel: Material of lid |
|---|---|---|---|---|---|---|---|---|---|
| 1 | $1.2 \times 10^{-4}$ | 540 | 2 | 9.5 | 540 | 2 | graphite (porosity 10%) | ID: 90 mm H: 7 mm | graphite (porosity 10%) |
| 2 | $1.0 \times 10^{-4}$ | 540 | 2 | 9.5 | 540 | 2 | graphite (porosity 10%) | ID: 90 mm H: 7 mm | graphite (porosity 10%) |
| 3 | $1.0 \times 10^{-4}$ | 540 | 2 | 1 | 540 | 8 | graphite (porosity 10%) | ID: 90 mm H: 7 mm | graphite (porosity 10%) |
| 4 | $1.2 \times 10^{-4}$ | 540 | 2 | 1 | 540 | 8 | graphite (porosity 10%) | ID: 90 mm H: 7 mm | graphite (porosity 10%) |
| 5 | $1.2 \times 10^{-4}$ | 540 | 2 | 9.5 | 540 | 2 | Recrystallized silicon carbide (porosity 20%) | ID: 90 mm H: 7 mm | Recrystallized silicon carbide (porosity 20%) |
| 6 | $1.2 \times 10^{-4}$ | 540 | 2 | 9.5 | 540 | 2 | Recrystallized silicon carbide (porosity 20%) | ID: 90 mm H: 7 mm | Recrystallized silicon carbide (porosity 20%) |

TABLE 6

| Comparative Example | Conditions of pre-treatment of reaction vessel: Dimension of lid | Temp. (° C.) | Vacuum degree (torr) | Heating time (hr.) | Measured result of reaction vessel after heating (ICP analysis): Al | Mg | Li | Ca | Measured result of glass wool after heating (ICP analysis): Al | Mg | Li | Ca |
|---|---|---|---|---|---|---|---|---|---|---|---|---|
| 1 | OD: 100 mm H: 5 mm | 540 | $1.2 \times 10^{-4}$ | 2 | 1.6 | 7.9 | <0.5 | <0.5 | 0.8 | 2.1 | <0.5 | <0.5 |
| 2 | OD: 100 mm H: 5 mm | 750 | $1.3 \times 10^{-4}$ | 2 | 1.1 | <0.5 | 18.2 | <0.5 | <0.5 | <0.5 | 2.4 | <0.5 |
| 3 | OD: 100 mm H: 5 mm | 750 | $2.1 \times 10^{-6}$ | 2 | 1.2 | <0.5 | <0.5 | 9.8 | <0.5 | <0.5 | <0.5 | 0.8 |
| 4 | OD: 100 mm H: 5 mm | 1000 | $1.1 \times 10^{-2}$ | 2 | 1.9 | 13 | <0.5 | <0.5 | 0.7 | 5.2 | <0.5 | <0.5 |
| 5 | OD: 100 mm H: 5 mm | 540 | $1.2 \times 10^{-4}$ | 2 | 0.7 | <0.5 | <0.5 | 17 | <0.5 | <0.5 | <0.5 | 2.8 |
| 6 | OD: 100 mm H: 5 mm | 1200 | $1.0 \times 10^{-2}$ | 2 | 0.8 | 10.1 | <0.5 | <0.5 | <0.5 | 3.7 | <0.5 | <0.5 |

TABLE 7

| Comparative Example | Substrate | Crystal phase | Film thickness (μm) | Result of EDS analysis: N At (%) | Mg | Al | Si | Color | Etching rate (mg/cm$^2$) |
|---|---|---|---|---|---|---|---|---|---|
| 1 | Mg—Si based Al alloy A6061 | Al | N.D. | 0 | 3.1 | 95.7 | 1.2 | ocher | 8.90 |
| | Pure Al (>99.5%) A1050 | Al | N.D. | 0 | <1 | 99.7 | 0.3 | gloss | 18.00 |
| 2 | Mg—Si based Al alloy A6061 | Al | N.D. | 0 | 3.3 | 95.2 | 1.5 | white | 14.90 |
| | Pure Al (>99.5%) A1050 | Al | N.D. | 0 | <1 | 99.1 | 0.9 | gloss | 17.60 |
| 3 | Mg—Si based Al alloy A6061 | Al | N.D. | 0 | 2.9 | 95.4 | 1.7 | white | 16.00 |
| | Pure Al (>99.5%) A1050 | Al | N.D. | 0 | <1 | 99.8 | 0.2 | gloss | 15.90 |
| 4 | Mg—Si based Al alloy A6061 | Al | N.D. | 0 | 3.4 | 95.1 | 1.5 | ocher | 9.10 |
| | Pure Al (>99.5%) A1050 | Al | N.D. | 0 | <1 | 99.4 | 0.6 | gloss | 19.10 |
| 5 | Mg—Si based Al alloy A6061 | Al | N.D. | 0 | 3.1 | 94.8 | 2.1 | white | — |
| | Pure Al (>99.5%) A1050 | Al | N.D. | 0 | <1 | 99.8 | 0.2 | gloss | — |
| 6 | Mg—Si based Al alloy A6061 | Al | N.D. | 0 | 3 | 95.8 | 1.8 | ocher | — |
| | Pure Al (>99.5%) A1050 | Al | N.D. | 0 | <1 | 99.9 | 0.1 | gloss | — |

As having been described in the above, according to the present invention, while a nitride film is formed on a metallic aluminum containing substrate, a fluctuation in a state of the nitride film formation can be prevented, or the formation of the nitride film can accelerated.

What is claimed is:

1. A process for nitriding a substrate containing at least metallic aluminum, said process comprising the steps of heating said substrate in vacuum of $10^{-3}$ torr or less, and heating/nitriding the substrate in an atmosphere containing at least nitrogen continuously to said heating step, wherein a porous body through which a nitrogen atoms-containing gas flows is clarified by heating at a temperature of 1000° C. or more under a pressure of $10^{-4}$ torr or less, and then said porous body is contacted with said atmosphere during the heating/nitriding step.

2. A process for nitriding a substrate containing at least metallic aluminum according to claim 1, wherein a temperature during said clarifying step is 1200° C. or more.

3. A process for nitriding a substrate containing at least metallic aluminum according to claim 2, wherein an amount of each of magnesium, lithium and calcium absorbed by said porous body after said clarifying step is 0.5 ppm or less.

4. A process for nitriding a substrate containing at least metallic aluminum according to claim 1, wherein a pressure during said clarifying step is $10^{-6}$ torr or less.

5. A process for nitriding a substrate containing at least metallic aluminum according to claim 1, wherein said porous body already used in said heating/nitriding step is subjected to said clarifying step before using it for the next heating/nitriding step, when said heating/nitriding step is repeated two or more times.

6. A process for nitriding a substrate containing at least metallic aluminum according to claim 1, wherein an amount of each of magnesium, lithium and calcium absorbed by said porous body after said clarifying step is 0.5 ppm or less.

7. A process for nitriding a substrate containing at least metallic aluminum according to claim 6, wherein an amount of each of metals belonging to Group lA, Group 2A, Group 3A, Group 4A and Group 4B in Periodic Table absorbed by said porous body after said clarifying step is 0.5 ppm or less.

8. A process for nitriding a substrate containing at least metallic aluminum according to claim 1, wherein said substrate is shielded from an outer environment by said porous body.

9. A process for nitriding a substrate containing at least metallic aluminum according to claim 1, wherein said substrate is placed inside a vessel made of said porous body.

10. A process for nitriding a substrate containing at least metallic aluminum according to claim 9, wherein vapor of at least one metal selected from the group consisting of Group 1A, Group 2A, Group 3A, Group 4A and Group 4B in Periodic Table is incorporated into said atmosphere.

11. A process for nitriding a substrate containing at least metallic aluminum according to claim 9, wherein a metal or an alloy of at least one metal selected from the group consisting of Group 1A, Group 2A, Group 3A, Group 4A and Group 4B in Periodic Table is placed in said vessel.

12. A process for nitriding a substrate containing at least metallic aluminum according to claim 9, wherein a porosity of said porous body is in a range of 1–30%.

13. A process for nitriding a substrate containing at least metallic aluminum according to claim 9, wherein pore sizes of said porous body is in a range of 1–100$\mu$m.

14. A process for nitriding a substrate containing at least metallic aluminum according to claim 9, wherein said porous body is made of graphite.

15. A process for nitriding a substrate containing at least metallic aluminum according to claim 9, wherein said porous body is made of a ceramic material.

16. A process for nitriding a substrate containing at least metallic aluminum said process comprising the steps of heating said substrate in vacuum of 10–3 torr or less, and heating/nitriding the substrate in an atmosphere containing at least nitrogen continuously to said heating step, wherein said heating/nitriding step is repeated two or more times and an amount of each of magnesium, lithium and calcium absorbed by a porous body through which a nitrogen atoms-containing gas flows is controlled to 0.5 ppm or less before subjecting it to the next heating/nitriding step.

17. A process for nitriding a substrate containing at least metallic aluminum according to claim 16, wherein a said porous body is clarified before the next heating/nitriding step by heating at a temperature of 1000° C. or more under a pressure of $10^{-4}$ torr or less.

18. A process for nitriding a substrate containing at least metallic aluminum according to Claim 17, wherein the temperature during said clarifying step is 1200° C. or more.

19. A process for nitriding a substrate containing at least metallic aluminum according to claim 17, wherein the pressure during said clarifying step is $10^{-6}$ torr or less.

20. A process for nitriding a substrate containing at least metallic aluminum according to Claim 17, wherein an amount of each of metals belonging to Group lA, Group 2A, Group 3A, Group 4A and Group 4B in Periodic Table absorbed by said porous body after said clarifying step is 0.5 ppm or less.

21. A process for nitriding a substrate containing at least metallic aluminum, said process comprising the steps of heating said substrate in vacuum of $10^{-3}$ torr or less, and heating/nitriding the substrate in an atmosphere containing at least nitrogen continuously to said heating step, wherein said heating/nitriding step is performed after a porous structural body of a furnace body for said heating/nitriding step is clarified by heating at a temperature of 1000° C. or more under a pressure of $10^{-4}$ torr or less.

22. A process for nitriding a substrate containing at least metallic aluminum according to claim 21, wherein the temperature during said clarifying step is 1200° C. or more.

23. A process for nitriding a substrate containing at least metallic aluminum according to claim 21, wherein the pressure during said clarifying step is $10^{-6}$ torr or less.

24. A process for nitriding a substrate containing at least metallic aluminum according to claim 21, wherein said porous structural body of the furnace body already used in said heating/nitriding step is subjected to said clarifying step before using it for the next heating/nitriding step, when said nitriding step is repeated two or more times.

25. A process for nitriding a substrate containing at least metallic aluminum according to claim 21, wherein an amount of each of magnesium, lithium and calcium absorbed by said porous structural body of the furnace body after said clarifying step is 0.5 ppm or less.

26. A process for nitriding a substrate containing at least metallic aluminum according to claim 25, wherein an amount of each of metals belonging to Group 1A, Group 2A, Group 3A, Group 4A and Group 4B in Periodic Table absorbed by said porous structural body of the furnace body after said clarifying step is 0.5 ppm or less.

27. A process for nitriding a substrate containing at least metallic aluminum, said process comprising the steps of heating a substrate containing at least metallic aluminum in vacuum of $10^{-3}$ torr or less, and heating/nitriding the substrate in an atmosphere containing at least nitrogen continuously to said heating step, wherein said heating/nitriding step is repeated two or more times and an amount of each of magnesium, lithium and calcium absorbed by porous structural body of the furnace body is controlled to 0.5 ppm or less before subjecting it to the next heating/nitriding step.

28. A process for nitriding a substrate containing at least metallic aluminum according to claim 27, wherein said porous structural body of the furnace is clarified before the next heating/nitriding step be heating at a temperature of 1000° C. or more under a pressure of $10^{-4}$ torr or less.

* * * * *